US006938893B2

(12) United States Patent
Shin

(10) Patent No.: US 6,938,893 B2
(45) Date of Patent: Sep. 6, 2005

(54) PAPER CASSETTE FOR IMAGE FORMING APPARATUS

(75) Inventor: Sang-yob Shin, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/780,608

(22) Filed: Feb. 19, 2004

(65) Prior Publication Data

US 2004/0164479 A1 Aug. 26, 2004

(30) Foreign Application Priority Data

Feb. 22, 2003 (KR) ..... 10-2003-0011199

(51) Int. Cl.[7] ..... B65H 3/54
(52) U.S. Cl. ..... 271/170; 271/171
(58) Field of Search ..... 271/147, 160, 271/170, 171

(56) References Cited

U.S. PATENT DOCUMENTS 4,780,740 A * 10/1988 Fukae ..... 399/86
4,828,245 A * 5/1989 Shimogawara ..... 271/171
5,163,670 A * 11/1992 Sellers et al. ..... 271/157
5,238,238 A * 8/1993 Shinohara et al. ..... 271/145
5,975,517 A * 11/1999 Lim ..... 271/117
5,992,843 A * 11/1999 Lee ..... 271/170
6,332,610 B1 * 12/2001 Hiura ..... 271/171
6,435,499 B1 * 8/2002 Tomatsu ..... 271/147

FOREIGN PATENT DOCUMENTS

JP 04140239 A * 5/1992 ..... B65H/3/56
JP 04173628 A * 6/1992 ..... B65H/1/26
JP 05139561 A * 6/1993 ..... B65H/3/56
JP 06199441 A * 7/1994 ..... B65H/3/56

* cited by examiner

*Primary Examiner*—David H. Bollinger
(74) *Attorney, Agent, or Firm*—Staas & Halsey LLP

(57) ABSTRACT

A paper cassette for an image forming apparatus includes a cassette body, a pair of aligning plates, paper separating fingers, and a biasing member. The cassette body has a knock-up plate on which paper is stackable. The pair of aligning plates are disposed on the paper cassette body and moving in a widthwise direction for aligning paper stacked on the knock-up plate in the widthwise direction. The paper separating fingers are disposed on the aligning plates and are vertically movable to a predetermined distance above the aligning plates, for pressing against two corners of a leading edge of an uppermost sheet of paper stacked on the knock-up plate. The biasing member is connected to at least a side of one of the paper separating fingers, for increasing a relative downward pressure exerted by the paper separating finger on the uppermost sheet of paper stacked on the knock up plate.

13 Claims, 3 Drawing Sheets

PAPER CASSETTE FOR IMAGE FORMING APPARATUS

CROSS-REFERENCE TO RELATED APPLICATIONS

This application claims the benefit of Korean Application No. 2003-11199, filed Feb. 22, 2003, in the Korean Intellectual Property Office, the disclosure of which is incorporated herein by reference.

BACKGROUND OF THE INVENTION

1. Field of the Invention

The present invention relates to an image forming apparatus, and more particularly, to a paper cassette for an image forming apparatus.

2. Description of the Related Art

An image forming apparatus, which may be used in an office or a home, for outputting a desired image by fusing ink or toner onto paper, has a paper cassette for in seriatim supplying the paper sheets to a printing engine for printing.

FIG. 1 shows a conventional paper cassette 100 for a conventional image forming apparatus (not shown). As shown in FIG. 1, the paper cassette 100 is mountable in a body (not shown) of the image forming apparatus with a plurality of sheets of paper being stacked on a knock-up plate 110. The topmost sheet of the paper stacked on the knock-up plate 110 is in contact with a pick-up roller 10, and both corners of a leading edge of the topmost sheet are in contact with a paper separating finger 120.

As shown in FIG. 2, when the pick-up roller 10 is driven in a clockwise direction, force is exerted to the topmost sheet in the direction of A. In this condition, the leading end of the topmost sheet is hindered from advancing due to the presence of the separating finger 120 and thus a part of the leading end of the topmost sheet is curved away from the sheet underneath it, so that the paper is fed to a printing engine by a feeding roller (not shown).

This conventional arrangement is not without drawbacks. For example, if the distance between the pick-up roller 10 and the paper separating finger 120 is extended to accommodate the use of a large-sized paper, multiple sheets of paper may be picked up. Accordingly, in order to prevent the picking-up of multiple sheets of paper, the pick-up roller 10 has to be positioned within a predetermined distance from the paper separating finger 120.

However, it is impractical for the conventional paper cassette 100 of the conventional image forming apparatus to have the pick-up roller 10 which is always positioned at an optimal distance from the paper separating finger 120 because various-sized papers are used. And, when the paper in use is large-sized, the occurrence of multiple sheet pick-up increases.

It is known to employ two spaced pick up rollers to remedy this multiple sheet pickup problem for A4 size paper. When using two spaced apart pick up rollers, the distance between the two pick-up rollers can be extended in order to prevent the pick up of multiple sheets of A4 paper. In this case, however, there is a disadvantage in that paper of a narrow width such as A5 size paper cannot be used.

SUMMARY OF THE INVENTION

The present invention has been developed in order to solve the above and/or other problems in the related art.

Accordingly, an aspect of the present invention is to provide a paper cassette for an image forming apparatus which is capable of using various-sized paper and preventing multiple picking-up.

The above and/or other aspects are achieved by providing, in one aspect of the present invention, a paper cassette for an image forming apparatus comprising a cassette body having a knock-up plate on which paper is stackable, a pair of aligning plates disposed on the paper cassette body and movable in a widthwise direction for aligning in the widthwise direction paper stacked on the knock-up plate, paper separating fingers disposed on the aligning plates and vertically movable through a predetermined distance above the aligning plates, for pressing against two corners of a leading edge of an uppermost sheet of paper stacked on the knock-up plate, and a biasing member connected to at least a side of one of the paper separating fingers, for increasing a relative downward pressure exerted by the paper separating finger on the uppermost sheet of paper stacked on the knock up plate.

The pressing member may be a spring having one end connected with the aligning plate and the other end connected to one side of the paper separating finger or a weight connected to one side of the paper separating finger.

At least one paper separating finger can be provided with a friction pad formed thereon.

The paper cassette for the image forming apparatus may include an aligning lever disposed on the knock-up plate and moving in a length direction, for aligning the paper stacked on the knock-up plate in length direction.

According to another aspect of the present invention, there is provided a paper separator for use in a paper cassette. The paper separator includes a body pivotably connected to a side of an alignment plate of the paper cassette and pivotable between a first position and a second position about a pivot point located substantially at a pivot end of the body; a pressing portion connected to the body at a pressing end opposite the pivot end; a travel limiter disposed between the pivot end and the pressing end which limits the pivotable travel of the body to between the first position and the second position; and a biasing unit disposed between the travel limiter and the pivot end which urges the body. At least a portion of a base plate which supports paper in the paper cassette is urged substantially upwardly and the biasing unit urges the body substantially downwardly.

According to still another aspect of the present invention, there is provided a paper cassette having a cassette body. The paper cassette includes: a support plate movably disposed within the cassette body and on which paper is stackable; a pair of aligning plates disposed on opposing sides of the cassette body and movable in a widthwise direction to align paper stacked on the support plate in the widthwise direction; paper separating fingers pivotably disposed on the aligning plates, an end of each of the paper separating fingers movable through a range of travel and pressable against a corner of a leading edge of an uppermost sheet of paper stacked on the support plate; and a biasing unit connected to at least a side of one of the paper separating fingers, for increasing a relative downward pressure exerted by the paper separating finger on the uppermost sheet of paper stacked on the knock up plate.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will be apparent and more readily appreciated from the following description of the preferred embodiments of the present invention with reference to the accompanying drawings, in which.

DETAILED DESCRIPTION OF THE PREFERRED EMBODIMENTS

Figure 1:
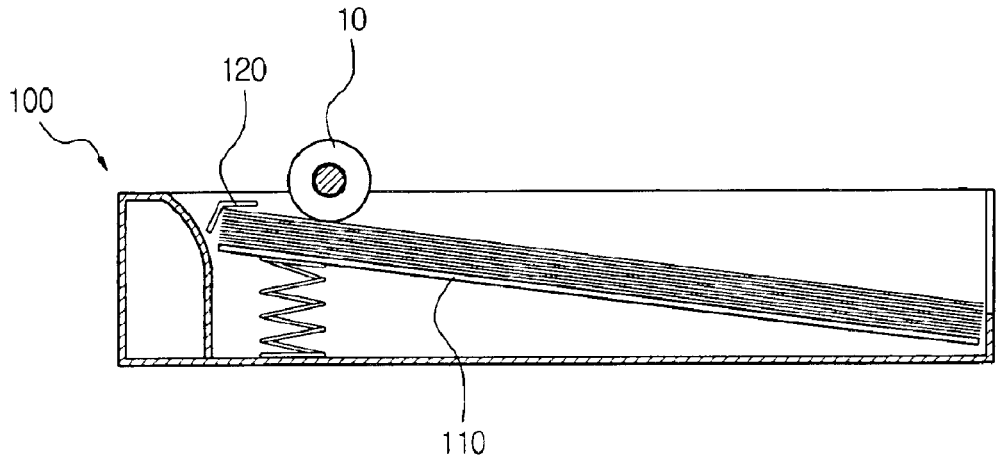
FIG. 1 (PRIOR ART)
FIG. 1 is a schematic side section view showing a conventional paper cassette for an image forming apparatus.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
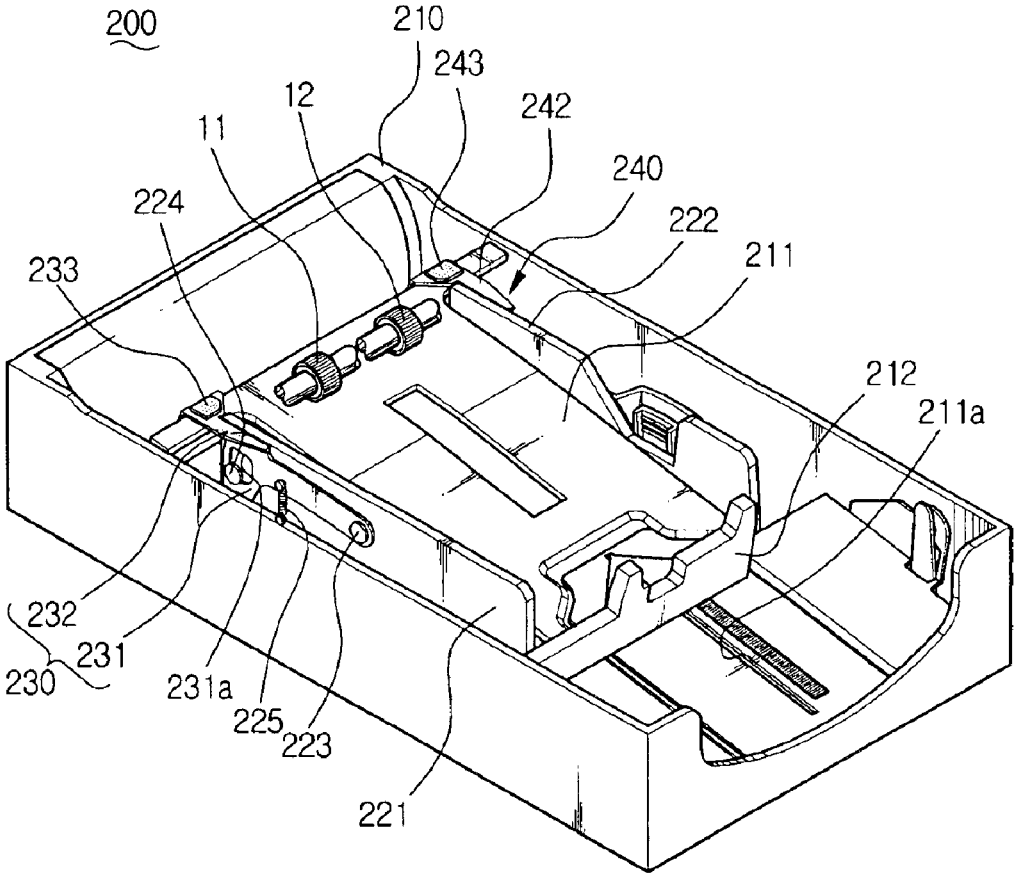
FIGS. 3 and 4 are schematic perspective views showing a paper cassette for an image forming apparatus according to an embodiment of the present invention.

As shown in FIG. 3, a paper cassette 200 for an image forming apparatus according to an embodiment of the present invention includes a cassette body 210, aligning plates 221, 222, and paper separating fingers 230, 240.

Figure 2:
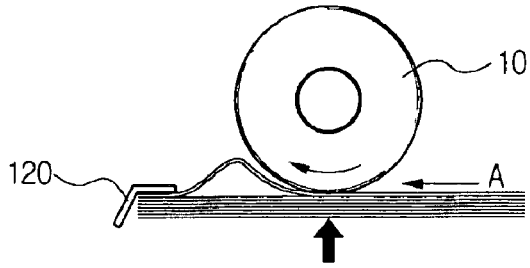
FIG. 2 (PRIOR ART)
FIG. 2 is a side section view showing the paper cassette of FIG. 1 to explain the paper separating operation.

The cassette body 210 has a storage space formed therein for storing paper, and the storage space is provided with a knock-up plate 211 on which sheets of paper are stacked. The knock-up plate 211 is supported by a spring 111 (an example of which is shown in FIG. 2) so as to be biased or urged upwardly so that the topmost sheet stacked on the knock-up plate 211 comes into contact with pick-up rollers 11, 12 disposed in a body of the image forming apparatus. Also, one side of the knock up plate 211 is provided with an aligning lever 212 for aligning the sheets in the length direction. The aligning lever 212 slides along a guide slit 211*a* formed in the knock-up plate 211 in a lengthwise direction to thereby align the sheets of paper stacked on the knock-up plate 211.

The aligning plates 221, 222 are disposed at both sides of the knock-up plate 211, for aligning the sheets of the paper in the width direction. The aligning plates 221, 222 slide along guide slits (not shown) formed in the cassette body 210 in a widthwise direction, to thereby align the sheets of the paper stacked on the knock-up plate 211.

Figure 5:
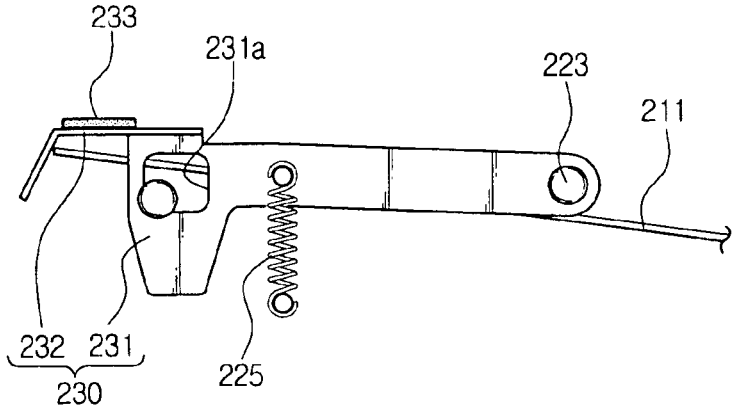
FIG. 5 is a side section view showing various parts of the paper cassette for the image forming apparatus according to the embodiment of the present invention illustrated in FIGS. 3 and 4.

The paper separating fingers 230, 240 prevent the pick up of multiple sheets of paper stacked on the knock-up plate 211, and are respectively disposed on the aligning plates 221, 222 to press both corners of a leading end of the paper. The paper separating finger 230, as shown in FIG. 5, includes a supporting portion 231 pivotably connected with the aligning plate 221 and a pressing portion 232 for pressing the corner of the leading end of the paper stacked on the knock-up plate 211.

The supporting portion 231 has one end pivotably connected with an outer surface of the aligning plate 211 on a pivoting point 223. The other end of the supporting portion 231 has a hole 231*a* of a predetermined size formed therein, for receiving a stopper pin 224 protruding from the outer surface of the aligning plate 221. Accordingly, the paper separating finger 230 is limited in its movement within a predetermined range because the stopper pin 224 moves within the hole 231*a*. Also, the pressing portion 232 is disposed at the other end of the supporting portion 231 and extended toward an end of the knock-up plate 211. The end of the pressing portion 232 is bent toward the knock-up plate 211 so that it comes into contact with the corner of the leading end of the paper. The pressing portion 232 is provided with a friction pad 233 formed thereon. The paper picked up from the knock-up plate 211 moves with a backside surface thereof in contact with the friction pad 233, thereby causing a friction. When multiple sheets are picked up, the sheets can be separated from each other due to the presence of the friction pad 233.

There is a spring 225 connected with one end to the supporting portion 231 of the paper separating finger 230. The other end of the spring 225 is connected with the outer surface of the aligning plate 221 so that the paper separating finger 230 is subject to the downward recovery force of the spring 225. Accordingly, the paper separating finger 230 presses the sheets of paper stacked on the knock-up plate 211 with a combined pressure of a self-weight of the paper separating finger 230 and the recovery force of the spring 225.

Hereinafter, the operations of the paper cassette 200 for the image forming apparatus according to the present invention will be described in greater detail.

When using small-sized paper such as, for example, A5 size paper having a width of 105 mm, the aligning lever 212 and the aligning plates 221, 222 are adjusted to be narrower in length and width according to the A5 size paper as shown in FIG. 3. Next, when the A5 size paper is stacked on the knock-up plate 211, both corners of a leading end of the A5 size paper are subjected to a predetermined pressure by the pressing portions 232, 242 of the paper separating fingers 230, 240. When the paper cassette 200 with the paper stacked therein is mounted in the body of the image forming apparatus, the pick-up rollers 11, 12 provided in pair in the body come into contact with top surfaces at both corner portions of the paper stacked on the knock-up plate 211.

When the pick-up rollers 11, 12 are driven, a friction occurs between the pick-up rollers 11, 12 and the A5 size paper, and the friction is exerted on the A5 size paper in the direction toward the separating fingers 230, 240. At this point, the leading end of the A5 size paper is hindered from advancing by a resistance of the paper separating fingers 230, 240, and thus a part of the leading end gets bent and starts separating from the underneath sheet. When the force generated at the bent portion of each corner of the A5 size paper becomes greater than the resistance of the paper separating fingers 230, 240, the leading end of the A5 size paper lifts the paper separating fingers 230, 240 and pops out of the paper separating fingers 230, 240. Then, the A5 size paper is fed to a printing engine by a feeding roller (not shown) provided in the body of the image forming apparatus.

Figure 4:
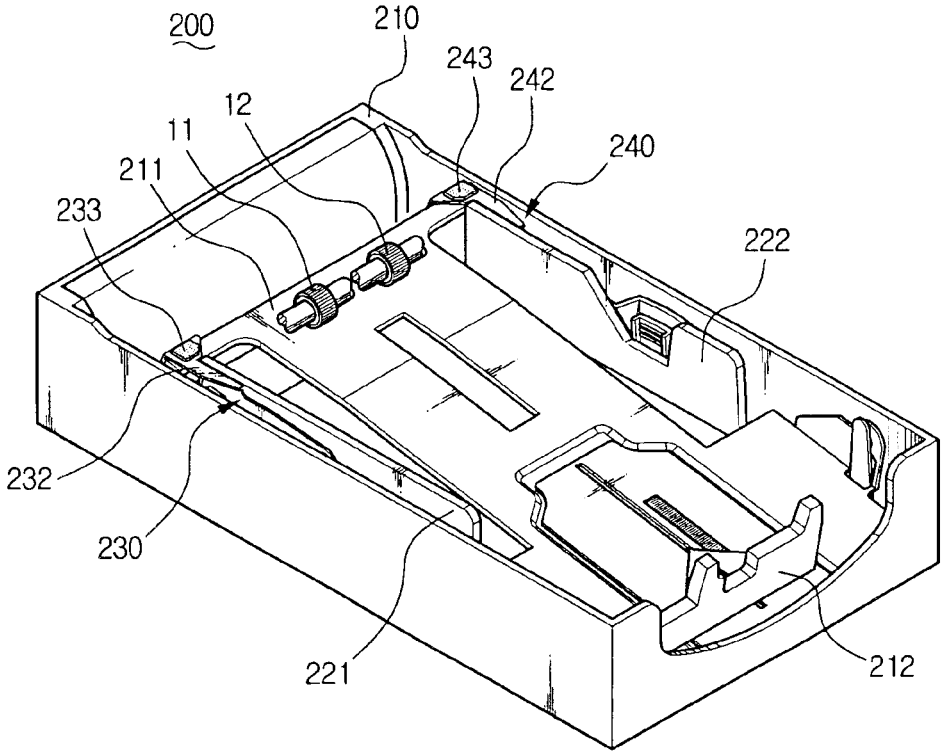

Meanwhile, when using large-sized paper, for example, a letter size paper having a width of 216 mm, the aligning lever 212 and the aligning plates 221, 222 are adjusted to be wider in length and width according to the letter size paper as shown in FIG. 4. When the letter size paper is stacked on the knock-up plate 211, both corners of leading end of the letter size paper are subjected to a predetermined pressure due to the pressing portions 232, 242 of the paper separating fingers 230, 240. When the paper cassette 200 with the paper stacked therein is mounted in the body of the image forming apparatus, the pair of pick-up rollers 11, 12 provided in the body come into contact with the top surface of the letter size paper stacked on the knock-up plate 211. And, since there is no variation in a position of installing the pick-up rollers 11, 12, the distance from a contacting portion between each pick-up roller 11, 12 and the letter size paper to the corner of the leading end of the letter size paper is greater than that of the A5 size paper.

When the pick-up rollers 11, 12 are driven, a force is exerted on the letter size paper toward the paper separating fingers 230, 240. The leading end of the letter size paper is hindered from advancing due to a resistance of the paper separating fingers 230, 242, and thus a part of the letter size paper gets bent and is separated from the lower sheet of the letter size paper. When the force generated by the bent portion of the letter size paper becomes greater than the resistance of the paper separating fingers 230, 240, the leading end of the letter size paper lifts the paper separating fingers 230, 240, pops out therefrom, and then is picked-up. The letter size paper takes much more time to pop out from the paper separating fingers 230, 240 than the A5 size letter, and the bent portion of the letter size paper is larger than that of the A5 size paper. However, since the resistance of the paper separating fingers 230, 240 against the movement of the letter size paper is greater than in the case of the A5 size paper, there is no paper slip. Accordingly, the picking-up of multiple sheets of paper is prevented, and, if multiple sheets of paper are picked up, the paper can be separated sheet by sheet by the contact with the friction pads provided on the paper separating fingers 230, 240.

Table 1 shows data obtained from various tests with respect to the frequency of multiple sheet pick up according to the level of resilient recovery force of the spring 225 exerted on the paper separating fingers 230, 240 and according to thickness of the friction pads 233, 243 used. As shown in Table 1, the occurrence of multiple sheet pick up occurs less frequently when the resistance of the paper separating fingers 230, 240 is combined with the resilient recovery force of the spring 225 than when the resistance of the paper separating fingers 230, 240 occurs by self-weight of the paper separating fingers 230, 240. Also, the presence of the friction pads 233, 243 makes the occurrence of multiple sheet pick up less frequent than in absence of the friction pads 233, 243.

TABLE 1

| Paper separating fingers | Initial State | Add resilient force 40 g | Add resilient force 60 g | Add friction pad 1t | Add friction pad 3t | Add resilient force 40 g and friction pad 3t | Add resilient force 60 g and friction pad 3t |
|---|---|---|---|---|---|---|---|
| Occurrence of multiple sheet pick up | 62/500 | 24/500 | 5/500 | 60/500 | 53/500 | 0/500<br>4/500<br>6/500 | 2/500<br>1/500<br>2/500 |

The embodiment illustrated in FIGS. 3 and 4 uses a construction in which the spring 225 acting as a pressing member presses the paper separating fingers 230, 240 downwardly in order to increase the resistance of the paper separating fingers 230, 240 against the movement of the paper. However, it is to be understood that other pressing or biasing arrangements may be used to increase the resistance of the paper separating fingers 230, 240 against the movement of the paper. By way of a non-limiting example, instead of the spring 225, a weight may be connected to each paper separating finger 230, 240 so as to increase the resistance of the paper separating fingers 230, 240 against the movement of the paper.

By increasing the resistance generated by the paper separating fingers 230, 240, which press both corners of the leading end of the paper, against the movement of the paper, the frequency of multiple sheet pick up is lessened, even when the distance between the corners of the paper and the pickup-rollers 11, 12 increases. Accordingly, the paper cassette capable of using various types of paper differing in width can be realized.

Although a few embodiments of the present invention have been shown and described, the present invention is not limited to the disclosed embodiment. Rather, it would be appreciated by those skilled in the art that changes and modifications may be made in this embodiment without departing from the principles and spirit of the invention, the scope of which is defined by the claims and their equivalents.

What is claimed is:

1. A paper cassette for an image forming apparatus comprising:

a cassette body having a knock-up plate on which paper is stackable;

a pair of aligning plates disposed on the cassette body and movable in a widthwise direction, aligning in the widthwise direction the paper stacked on the knock-up plate;

paper separating fingers disposed on the aligning plates and vertically movable through a predetermined distance above the aligning plates, pressing against corners of a leading edge of an uppermost sheet of paper stacked on the knock-up plate; and a biasing member connected to at least a side of one of the paper separating fingers, increasing a relative downward pressure exerted by the paper separating finger on the uppermost sheet of paper stacked on the knock up plate, wherein the biasing member is a weight connected to at least a side of the one separating finger.

2. The paper cassette of claim 1, wherein the biasing member is a spring having an end connected to an aligning plate and another end connected to at least a side of the one paper separating finger.

3. The paper cassette of claim 1, further comprising an aligning lever disposed on the knock-up plate and moving in a lengthwise direction, aligning in the lengthwise direction the paper stacked on the knock-up plate.

4. The paper cassette of claim 1, wherein each paper separating finger is biased by a biasing member toward the paper to increase the relative downward pressure exerted on the uppermost sheet of the paper.

5. The paper cassette of claim 1, wherein the paper separating finger biased by the biasing member has a pressing portion at a paper contacting end and pivots about an axis substantially at an end distal to the paper contacting end.

6. The paper cassette of claim 5, wherein the aligning plate to which the paper separating finger biased by the biasing member is pivotably connected has a stop pin and the biased paper separating finger has a hole configured to receive the stop pin and allow limited pivotable travel of the paper separating finger.

7. A paper cassette for an image forming apparatus comprising:

a cassette body having a knock-up plate on which paper is stackable;

a pair of aligning plates disposed on the cassette body and movable in a widthwise direction, aligning in the widthwise direction the paper stacked on the knock-up plate;

paper separating fingers disposed on the aligning plates and vertically movable through a predetermined distance above the aligning plates, pressing against corners of a leading edge of an uppermost sheet of paper stacked on the knock-up plate; and a biasing member connected to at least a side of one of the paper separating fingers, increasing a relative downward pressure exerted by the paper separating finger on the uppermost sheet of paper stacked on the knock up plate, wherein at least one paper separating finger is provided with a friction pad.

8. The paper cassette of claim 7, wherein the friction pad is provided on a side of the at least one paper separating finger opposite of a side from which the paper is stacked so as to contact a side of a sheet of paper picked up from the knock-up plate.

9. A paper separator for use in a paper cassette, having a base plate which supports paper in the cassette and an alignment plate which aligns the paper, comprising:

a body pivotably connected to a side of the alignment plate and pivotable between a first position and a second position about a pivot point located substantially at a pivot end of the body;

a pressing portion connected to the body at a pressing end opposite the pivot end;

a travel limiter disposed between the pivot end and the pressing end, which limits the pivotable travel of the body to between the first position and the second position; and a biasing unit disposed between the travel limiter and the pivot end which urges the body, wherein at least a portion of the base plate is urged substantially upwardly and the biasing unit urges the body substantially downwardly, wherein the biasing unit is a weight connected to a side of the body.

10. The paper separator of claim 9, wherein the biasing unit is a spring attached at one end to a side of the body and at another end to the aligning plate.

11. The paper separator of claim 9, wherein a stop pin extends from each of the alignment plates and the travel limiter comprises a hole that receives the stop pin and has at least one of a diameter and a linear direction greater than that of the stop pin so as to define ends of a range of travel of the paper separating fingers.

12. A paper cassette having a cassette body, the paper cassette comprising:

a support plate movably disposed within the cassette body and on which paper is stackable;

a pair of aligning plates disposed on opposing sides of the cassette body and movable in a widthwise direction to align paper stacked on the support plate in the widthwise direction;

paper separating fingers pivotably disposed on the aligning plates, an end of each of the paper separating fingers movable through a range of travel and pressable against a corner of a leading edge of an uppermost sheet of paper stacked on the support plate; and a biasing unit connected to at least a side of one of the paper separating fingers, increasing a relative downward pressure exerted by the paper separating finger on the uppermost sheet of paper stacked on the knock up plate, wherein the biasing unit is a weight connected to a side of the body.

13. The paper separator of claim 12, wherein the biasing unit is a spring attached at one end to a side of the cassette body and another end to the paper separating finger.

* * * * *